US006303870B1

(12) United States Patent
Nazaryan et al.

(10) Patent No.: US 6,303,870 B1
(45) Date of Patent: Oct. 16, 2001

(54) INSULATOR COVER

(75) Inventors: Nikolay Nazaryan, West Hartford, CT (US); Stanley S. Orkin, Jensen Beach, FL (US); Glen Greenberg, Avon, CT (US)

(73) Assignee: Turbine Controls, Inc., Bloomfield, CT (US)

( * ) Notice: Subject to any disclaimer, the term of this patent is extended or adjusted under 35 U.S.C. 154(b) by 0 days.

(21) Appl. No.: 09/243,953

(22) Filed: Feb. 3, 1999

(51) Int. Cl.[7] ..... H01B 17/16

(52) U.S. Cl. ..... 174/172; 174/5 R; 174/155; 174/158 R; 174/176; 174/189; 174/209

(58) Field of Search ..... 174/168, 5 R, 174/155, 156, 158 R, 172, 173, 176, 177–179, 189, 196, 209, 211

(56) References Cited

U.S. PATENT DOCUMENTS

| | | | | |
|---|---|---|---|---|
| 1,764,418 | * | 6/1930 | Schramm | 174/179 |
| 1,764,434 | * | 6/1930 | Cochran | 174/189 |
| 2,065,315 | * | 12/1936 | Keath | 174/5 R |
| 2,099,540 | | 11/1937 | Smith | 173/28 |
| 2,933,553 | * | 4/1960 | Zuhlke | 174/211 |
| 2,946,841 | * | 7/1960 | Wagner | 174/5 R |
| 3,042,736 | * | 7/1962 | Salisbury | 174/5 R |
| 3,270,120 | | 8/1966 | VanName et al. | 174/1 |
| 3,459,881 | | 8/1969 | Sonnenberg et al. | 174/144 |
| 3,604,830 | | 9/1971 | Frakes | 174/31 |
| 4,028,656 | * | 6/1977 | Schmunk et al. | 174/189 |
| 4,053,707 | | 10/1977 | ELy et al. | 174/212 |
| 4,280,013 | * | 7/1981 | Clutter | 174/5 R |
| 4,879,436 | | 11/1989 | Braham | 174/92 |
| 5,023,406 | | 6/1991 | Thornley | 174/209 |
| 5,153,383 | | 10/1992 | Whited et al. | 174/135 |
| 5,417,592 | * | 5/1995 | West | 439/624 |
| 5,446,242 | | 8/1995 | Barrett | 174/140 |

FOREIGN PATENT DOCUMENTS

| | | | |
|---|---|---|---|
| 900233 | | 7/1949 | (DE) . |
| 2258352A | * | 3/1993 | (GB) . |

* cited by examiner

*Primary Examiner*—Dean A. Reichard
*Assistant Examiner*—Adolfo Nino
(74) *Attorney, Agent, or Firm*—Wiggin & Dana; William B. Slate

(57) ABSTRACT

An insulative cover is utilized to protect an insulator supporting an electrical power line relative to a support structure in an electrical power transmission system. A first end of the cover is secured to the insulator adjacent the insulator's first end and a second end of the cover is secured to the insulator adjacent to the insulator's second end. The cover defines a volume substantially enclosing a central portion of the insulator.

21 Claims, 5 Drawing Sheets

INSULATOR COVER

BACKGROUND OF THE INVENTION (1) Field of the Invention

This invention relates to protective barrier structures for electrical insulators, and more particularly to particular cover structures for shed-type insulators and their use with power transmission lines.

(2) Description of the Related Art

In the field of electrical power transmission, high voltage power lines (typically operating in excess of 1 kV) are supported by structures such as utility poles. To prevent leakage of power from the lines into the supporting structure, the lines are advantageously held at one end of an insulator, which in turn is held at its other end by the supporting structure. Common insulators are formed of ceramic, porcelain, epoxy, or other electrically nonconductive materials. As such insulators are used in the open, they are exposed to rain (including acid rain), humidity, salt fog, acid fog, particulate pollutants, and other environmental contaminants.

If a continuous surface of electroconductive moisture existed between the ends of the insulator (e.g., deposited as rain), it would provide a conductive path between the line and the supporting structure. To avoid this, insulators are configured so that water does not accumulate over a continuous surface between the two ends. In "shed"-type insulators this may involve providing the insulator as the combination of: a body (also known as a core or stem) which is formed in a generally circular cylindrical or frustoconical shape; and a number of "sheds" formed as annular flanges projecting radially outward and longitudinally/vertically downward from the body. Both the upper surface of each shed and the lower surface (underside) of each shed along substantial portions thereof are inclined downward, leaving the underside of each shed largely protected from falling rain and preventing a continuous flow of water from end-to-end.

The surfaces of such insulators may be contaminated in other ways so as to compromise their insulative properties. For example, in coastal areas, wind-blown, salt-laden, mist may deposit salt over substantially the entire exposed surface of the insulator. Such salt can become embedded in the porous surface of the insulator and, eventually, provide a conductive pathway from the wire to the supporting structure. Wind-blown sand may abrade the surface of the insulator, increasing porosity and rendering the insulator more susceptible to later water or salt contamination. In industrial areas, chemical and particulate pollution may similarly compromise the insulator. To partially address these problems, it is known to periodically wash the insulators with a high pressure stream of water. Such a stream may be delivered from the ground or from the air such as from a helicopter. To avoid the risk of conducting electricity from the lines through the stream of water, power to the lines is advantageously shut off during cleaning. Although shutting off the power for cleaning may be optional, it is substantially required during replacement of the insulator. Furthermore, cleaning may not be complete and the service life of the insulator may be diminished.

It is thus desirable to reduce the required cleaning of insulators and extend their service lives.

BRIEF SUMMARY OF THE INVENTION

Accordingly, in a first aspect, the invention is directed to an insulative cover having a first end secured to the insulator adjacent the insulator's first end and a second end secured to the insulator adjacent the insulator's second end. The cover enshrouds a central portion of the insulator. The cover may define a substantially sealed volume surrounding the central portion. The insulative cover may have first and second pieces, each being the unitarily-formed combination of a body, first and second vertical flanges extending along first and second sides of the body, and first and second collar sections at first and second ends of the body. The bodies may form a series of reduced diameter regions alternating with a series of enhanced diameter regions, each reduced diameter region having a minimum diameter smaller than a maximum diameter of an adjacent enhanced diameter region. Each enhanced diameter region may accommodate an associated shed of the insulator.

The reduced and enhanced diameter regions may form a series of sheds on the cover. Each of the cover's sheds has an upper surface which substantially slopes downward in the outward radial direction and a lower surface which substantially slopes downward in the outward radial direction. An end surface joins the upper and lower surfaces.

The first and second pieces may be formed essentially from a fluorocarbon-vinylidene fluoride/hexifluoropropylene. The first and second insulator ends may be formed by first and second metallic end caps and first and second tie wraps may secure the respective first and second cover ends proximate the first and second insulator ends.

In a second aspect, the invention is directed to a combination for supporting a power line relative to a support structure in an electrical power transmission system. An insulator has a first end secured to the support structure and a second end carrying the power line. An insulative cover has a first end secured to the insulator adjacent the insulator's first end and a second end secured to the insulator adjacent the insulator's second end. The cover defines a volume substantially enclosing a central portion of the insulator. The insulator's first end may be an upper end and the insulator's second end may be a lower end. The volume may be a sealed volume or it may include at least one vent hole preferably no greater than 1 sq. mm in cross-section. The support structure may be a utility pole and the insulator's first end may comprise a metal fitting bolted to the pole. The insulator's second end may comprise a metal fitting into which at least one eyebolt is threaded for supporting the power line.

In a third aspect, the invention is directed to a method for protecting an insulator in an electrical transmission system from environmental contaminants. An insulative cover is provided. The insulator is surrounded with the cover. A first end of the cover is secured to the insulator adjacent to the insulator's first end. A second end of the cover is secured to the insulator adjacent to the insulator's second end. This defines a substantially sealed volume surrounding a central portion of the insulator which is effective to protect such central portion from environmental contaminants. The surrounding step may include placing a first cover half on a first side of a separation plane extending longitudinally through the insulator and placing a second cover half on a second side of the separation plane. The first half is then secured to the second half. The method may be performed in situ while the power line is supported by the insulator and carries an alternating current voltage (e.g., in excess of 1 kV).

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
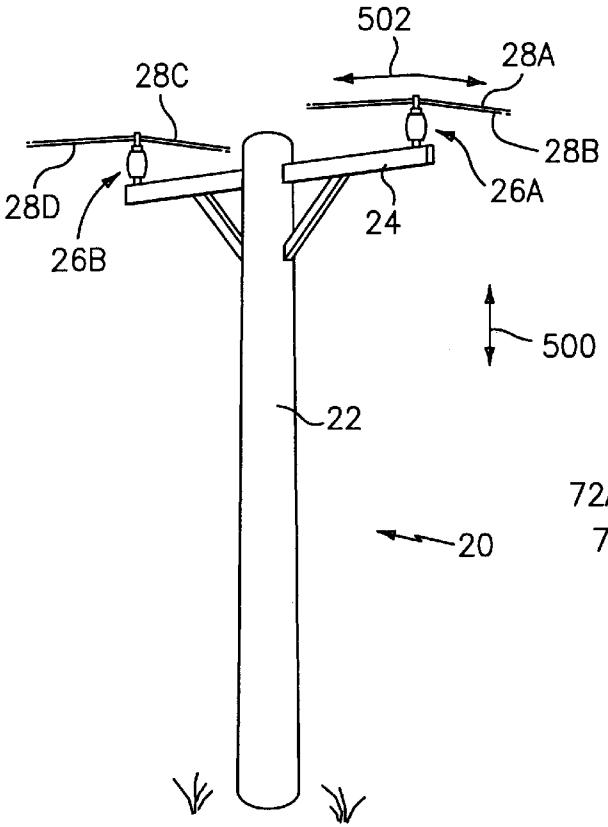
FIG. 1 is a view of a utility pole.

FIG. 1 shows a utility pole 20 having a central mast or pole 22 extending vertically from a lower end embedded in the ground to an upper end proximate which a horizontally-extending crossarm 24 is mounted. Extending upward from opposite ends of the crossarm 24 are first and second covered insulators 26A and 26B. At their upper ends, the insulators carry medium tension distribution lines/wires 28A–28D.

Figure 2:
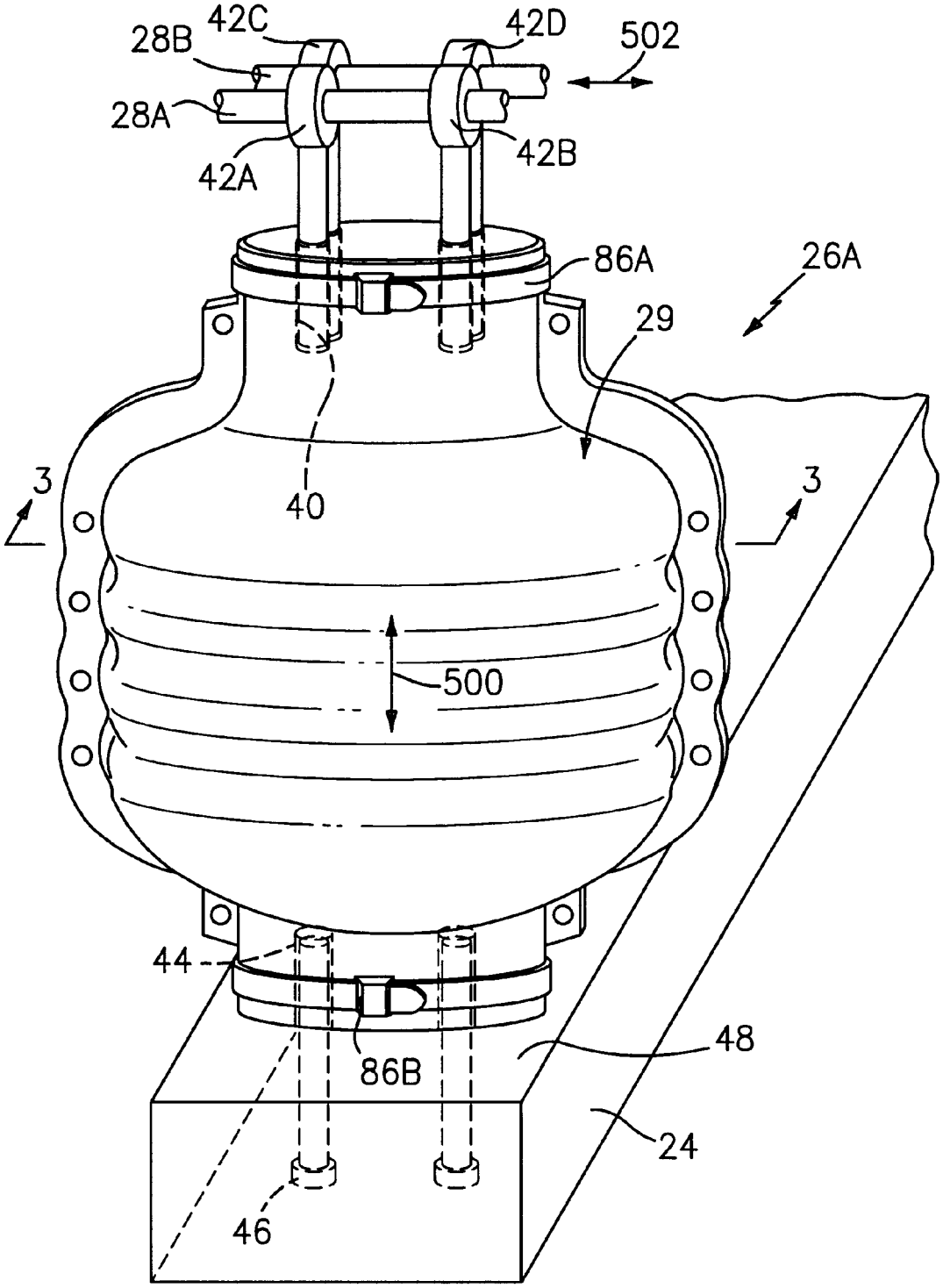
FIG. 2 is an enlarged view of a covered insulator on the utility pole of FIG. 1.
Figure 3:
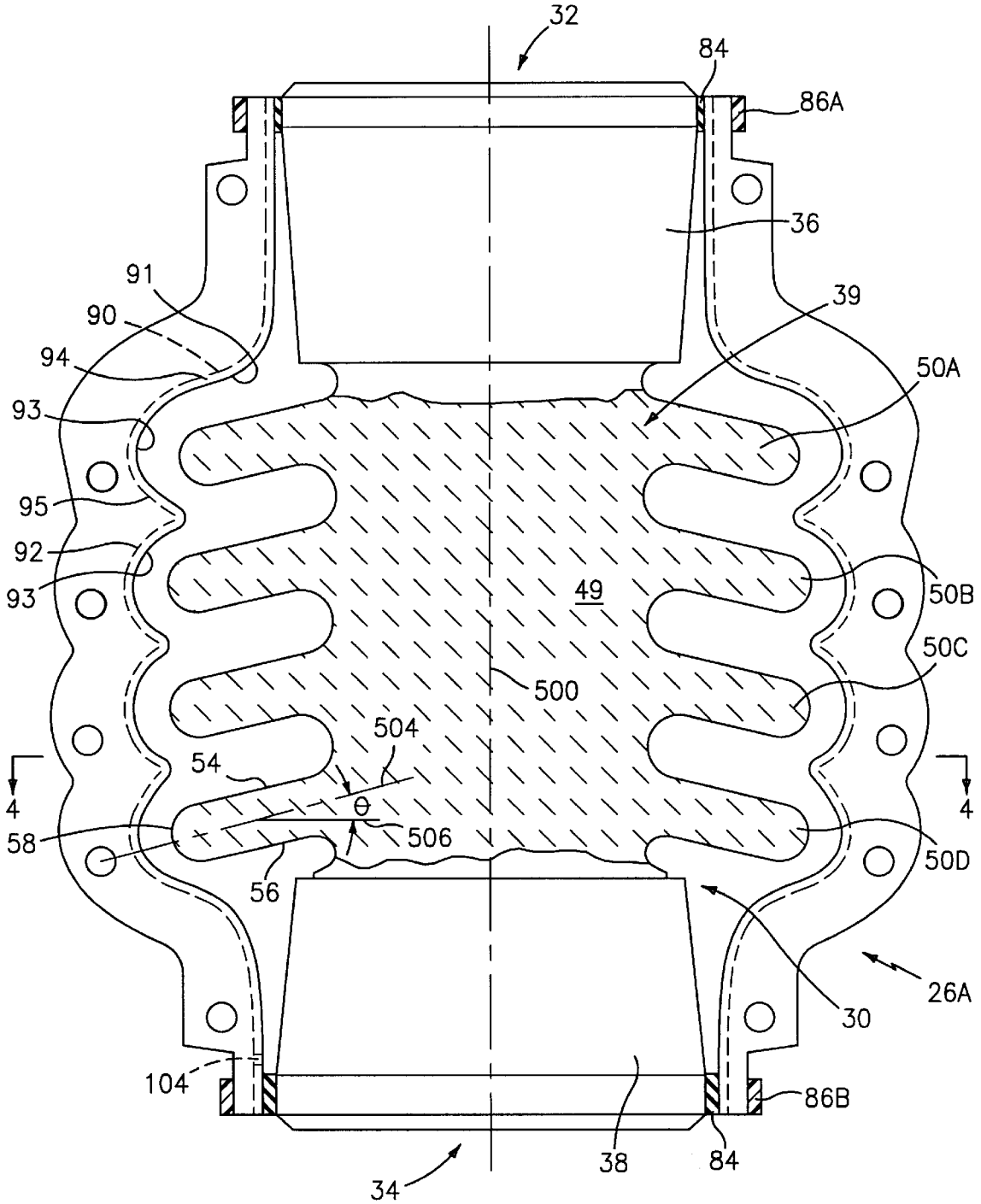
FIG. 3 is a partial cutaway view of the covered insulator of FIG. 2.

FIGS. 2 and 3 show the covered insulator 26A in further detail. FIG. 3 shows the covered insulator 26A with half of the cover 29 removed. Within the cover 29 the basic insulator 30 shown in FIG. 3 may be of any appropriate type. The insulator 30 extends an insulator axis 500 from a first end 32 to a second end 34. In the illustrated use, the insulator axis 500 is substantially vertical with the first end 32 being an upper end and the second end 34 being a lower end. At the respective upper and lower ends 32 and 34, the insulator 30 includes respective upper and lower metallic end caps or fittings 36 and 38. The fittings 36 and 38 surround upper and lower ends of an insulative member 39 formed of ceramic, porcelain, resin, or other rigid electrically non-conductive material.

FIG. 3 shows that the insulator 30 has angular symmetry about the axis 500 with exceptions for various connective features such as threaded holes 40 and 44 (FIG. 2) in the respective upper and lower fittings 36 and 38. The four threaded holes 40 receive a first pair of eyebolts 42A and 42B and a second pair of eyebolts 42C and 42D. The first wire 28A passes through the eyes of the first pair of eyebolts and the second wire 28B passes through the eyes of the second pair of eyebolts. The wires extend in a wire direction 502 generally transverse to the insulator axis 500. The four threaded holes 44 (FIG. 2) in the lower fitting 38 (FIG. 3) may be identically formed to the threaded holes 40 and may receive bolts 46 (FIG. 2) extending through the crossarm 24 to secure the insulator 30 atop the upper surface 48 of the crossarm.

As shown in FIG. 3, the insulative member 39 includes the unitarily formed combination of a central core or body 49 and a plurality of annular sheds 50A–50D extending radially outward and slightly downward from the core 49. Each shed includes an upper surface 54, a lower surface 56, and an end surface 58 joining the upper and lower surfaces. In the exemplary embodiment, over a substantial portion of their radial extent the upper and lower surfaces 54 and 56 are parallel to each other and are angled downward in the outward radial direction (e.g., at an angle θ of about 10–30°). In FIG. 3, the angle θ is shown separating a central frustoconical median 504 of a shed from a horizontal plane 506.

Figure 4:
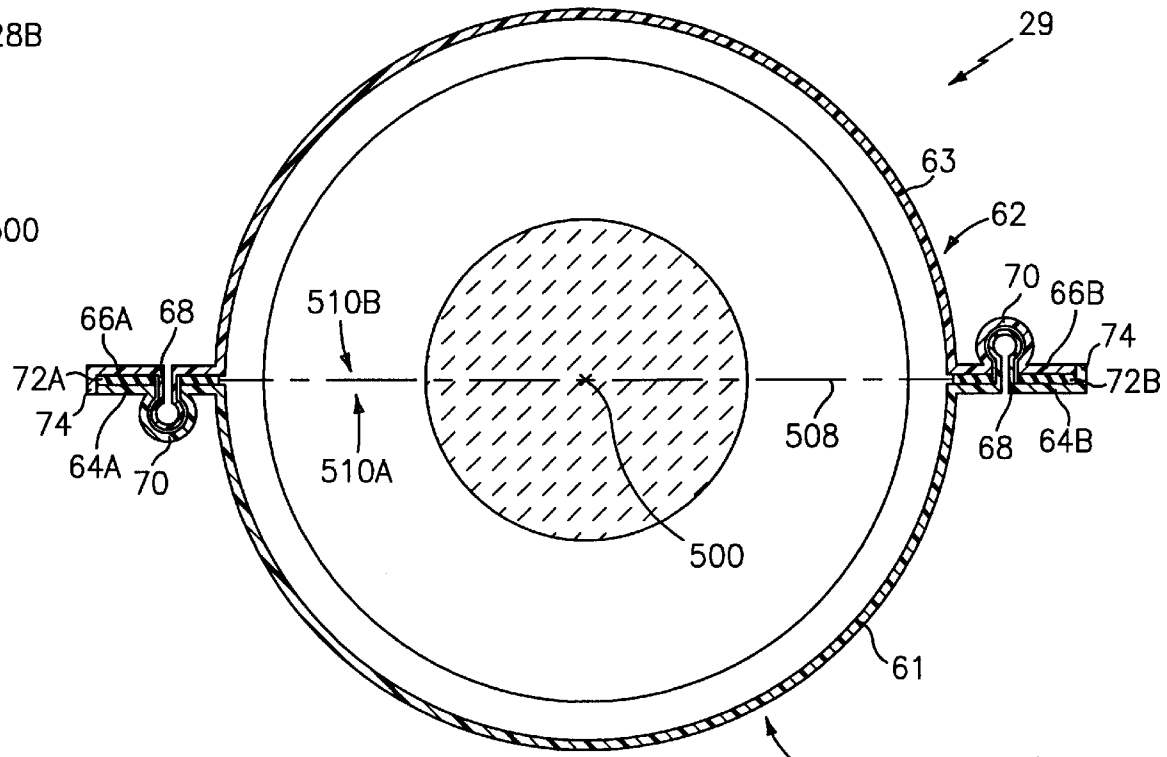
FIG. 4 is a partial transverse sectional view of the covered insulator of FIGS. 2 and 3 taken along line 4—4 of FIG. 3.

FIG. 4 shows the cover 29 assembled from first and second halves 60 and 62 which, with the exception of interlocking features described below, are substantially mirror images of each other about a vertical separation plane 508. The halves 60 and 62 have respective central body portions 61 and 63 extending nearly 180° about the insulator axis 500. Extending vertically along first and second sides of the body 61, the first half 60 has flanges 64A and 64B, respectively, on a first side 510A of the separation plane 508. Along first and second sides of the body 63, the second half 62 has flanges 66A and 66B, respectively, on the second side 510B of the separation plane 508. To secure the two halves together, the flanges have interlocking features formed as male projections 68 and associated female receptacles 70. The projections 68 may be formed on the flanges 64B and 66A while the receptacles 70 are formed on the flanges 64A and 66B. In certain embodiments such a configuration allows two halves 60 and 62 to be manufactured as identical pieces. Alternatively, the projections may be on the flanges of one of the cover halves while the receptacles are on the flanges of the other, or each flange may have an alternating series of projections and receptacles mating with respective receptacles and projections of the associated flange of the other cover half. Between associated flanges, a rubber gasket 72A, 72B (e.g., silicone, butyl, or neoprene rubber) provides a seal between surfaces of the flanges facing the separation plane 508. At their outboard edges, the flanges 64B and 66A of the first half 60 and second half 62 respectively bear a rib 74 which spans the separation plane 508 to cover outboard edges of the associated gasket 72A, 72B and adjacent flange 64A and 66B.

Figure 5:
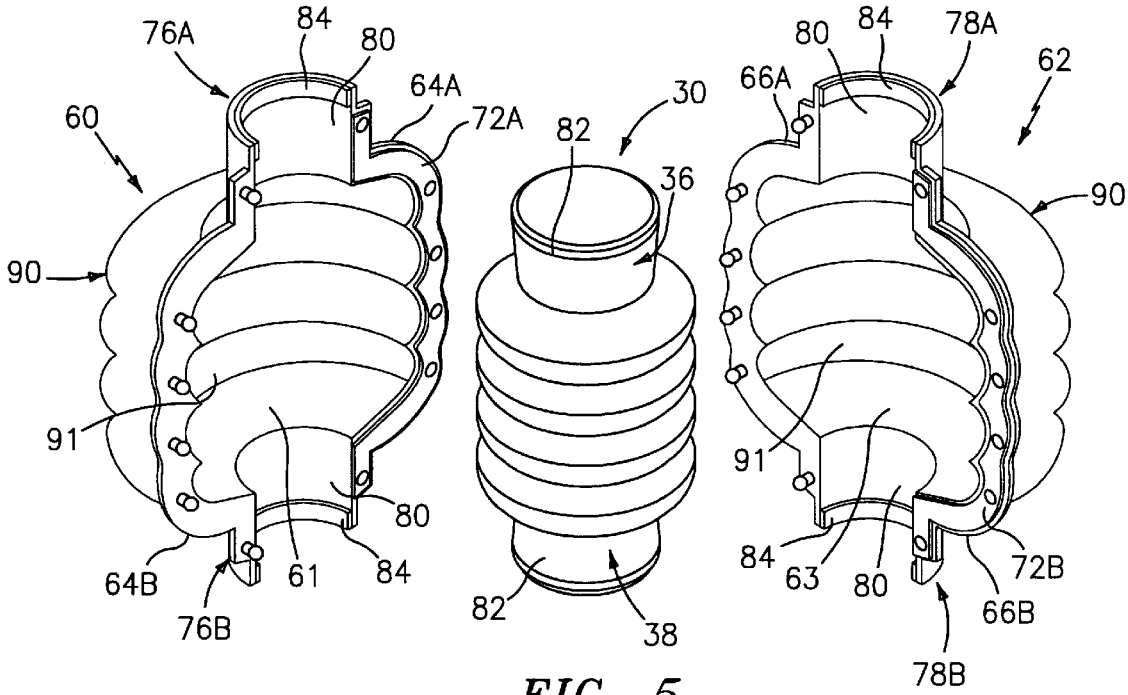
FIG. 5 is a partial exploded view of the covered insulator of FIG. 2.

FIG. 5 shows the two cover halves 60 and 62 prior to being secured over the insulator 30. The cover may be assembled in situ with the wires hot. The rubber gaskets 72A, 72B may initially be provided having adhesive on both surfaces with release tape (not shown) covering such adhesive. The gaskets 72A and 72B are preferably pre-installed on one or both of the halves 60 and 62 via removal of the release tape from one surface and the application of such gasket to the inboard surface of the flange of the associated cover half. FIG. 5 shows the gaskets 72A and 72B preinstalled on the flanges 64A and 66B. At its upper and lower ends, the first half 60 includes fitting-engaging collar portions 76A and 76B, respectively, extending from upper and lower ends of the body 61. In the illustrated embodiment, these are formed as a nearly 180° sector of an annular sleeve. The second half 62 includes similar collar portions 78A and 78B, respectively, extending from upper and lower ends of the body 63. The inboard surfaces of the collar portions 76A, 76B, 78A, 78B are configured to engage with the lateral surfaces 82 of the fittings 36 and 38. Each inner surface 80 bears a gasket 84 which may be formed of a similar material as the gaskets 72A and 72B. The halves 60 and 62 are brought into proximity with the insulator 30 and the remaining release tape removed from the exposed surfaces of the gaskets 72A and 72B and the four gaskets 84. The two halves are then assembled over the insulator with the projections 68 being locked into the associated receptacles 70. The gaskets 72A and 72B provide a seal between the two halves and the gaskets 84 provide a seal between the assembled halves and the fittings 36 and 38 thus defining a sealed volume between the cover and insulator. To further supplement the adhesion and sealing provided by the gaskets 84, a pair of upper and lower plastic tie wraps 86A and 86B are wrapped around and cinched over the assembled upper collar portions 76A and 78A and lower collar portions 76B and 78B, respectively, to firmly clamp such portions to the associated upper and lower fittings 36 and 38.

As is shown in FIG. 3, the assembled cover 29 has an outer or exterior surface 90 and an interior surface 91 substantially parallel to the exterior surface and spaced apart therefrom by a cover thickness of from about 0.04 in to about 0.10 in. The outer surface is formed having a vertically-arrayed series of annular protuberances at substantially even level with the ends 58 of associated sheds 50A–50D. The protuberances each define an enlarged diameter area of the cover, with reduced diameter areas being located between adjacent protuberances. The protuberances have convex outer surface portions 92 of the exterior surface 90, each of which has an associated concave portion 93 of the interior surface 91. Each protuberance has an upper surface portion 94 and lower surface portion 95 along the exterior surface 90.

Figure 6:
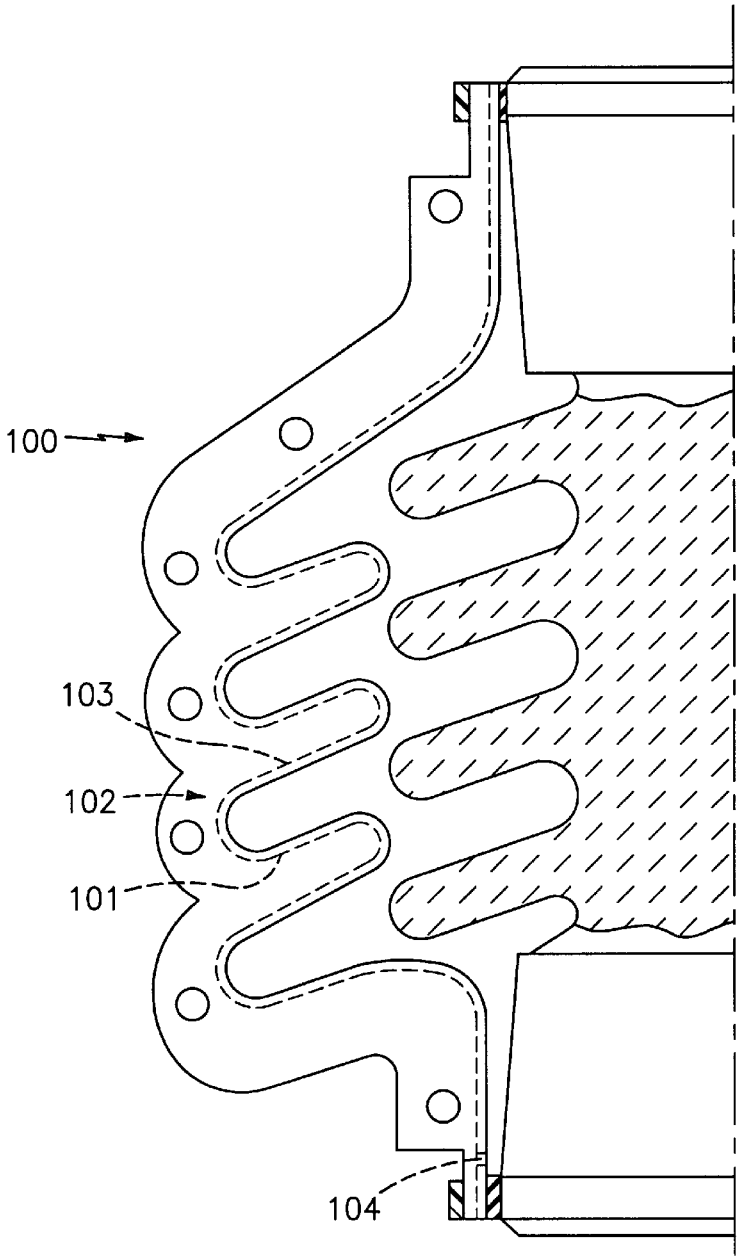
FIG. 6 is a partial sectional view of an insulator bearing an alternate cover.

FIG. 6 shows a partial sectional view of an alternate cover 100 which more closely accommodates the profile of the sheds of the insulator. This configuration has the advantage of providing the cover with its own shed-like construction that shields the undersides 101 of the cover sheds 102 from rain, etc. Thus, both the upper surface 103 and underside 101 of each shed 102 predominately slope downward in the outward radial direction. However, this construction complicates manufacturing. Advantageously, the projections and receptacles of the cover 100 are located in phase with the cover's sheds (e.g. substantially along the frustoconical median of each such shed rather than closer to intermediate such medians).

Figure 7:
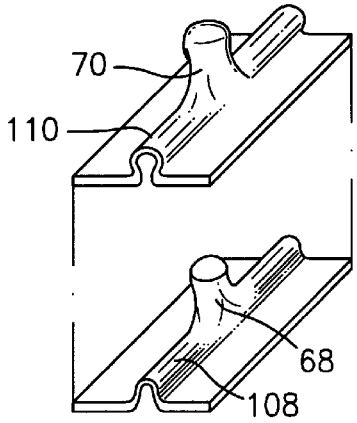
FIG. 7 is a partial sectional view of an alternate flange construction for an insulator cover.

FIG. 7 shows a partial sectional view of an alternate flange construction wherein the male projections 68 are supplemented by an elongate male protrusion 108 running between the projections 68 and projecting parallel therewith. A mating female channel 110 similarly connects the receptacles 70. The protrusion 108 and channel 110 cooperate when the two halves are assembled to provide a seal running along the mated flanges. This seal may replace that provided by the elastomeric gaskets 72A and 72B or may complement seals formed by gaskets running inboard and/or outboard of the mated protrusion and channel.

The material chosen for the cover should have low electrical conductivity, low surface porosity (in particular, the surface should be highly hydrophobic), high physical robustness (including both strength and abrasion resistance) and high stability (including resistance to heat and deteriorative effects of UV light). High molecular density polymers are believed particularly advantageous. One particularly preferred polymer is sold under the trademark KYNAR FLEX 2850 by Elf Atochem North America, Philadelphia, Pa. This is a fluorocarbon-vinylidene fluoride/hexifluoropropylene thermoplastic (VDF/BFP (TP)). This material has a density of 1.78 g/cm$^3$, a melting point of 138° C., a volume resistivity of $2\times10^{14}$ Ohm-cm, a dielectric constant of 7.8 at 1 MHz, a dissipation factor of $2\times10^{-2}$ at 1 MHz, a coefficient of linear thermal expansion of $9.9\times10^{-5}$ mm/mm/°K, and a water absorption of 0.04% at twenty-four hours. This exemplary material is believed to offer a particularly advantageous combination of properties and cost. Other suitable materials include polyvinylidene fluoride (PDVF), polytetrafluoroethylene (PTFE), fluorinated ethylene-propylene (FEP), ethyltetrafluoroethylene (ETFE), ethylchlorotrifluoroethylene (ECTFE), polypropylene, polyvinyl chloride, polyethylene (Type 1), polyetherimide, and polyethersulfone. Advantageously, the material used for the cover should have a dielectric strength greater than about 10 kV/mm, a volume resistance of about $10^{13}$–$10^{16}$ Ohm-cm, a surface resistance of $10^{15}$–$10^{17}$ Ohm, a dielectric constant of 2.5–8, a dissipation factor of $10^{-3}$–$10^{-1}$, a coefficient of linear thermal expansion of about $10^{-6}$–$10^{-4}$ in/in/°F. ($10^{-5}$–$10^{-3}$ mm/mm/°K), and a twenty-four hour water absorption of about 0.01%–0.04% for 24 hours. An advantageous service temperature ranges from about −30° F. to 180° F.

The cover encloses a sealed volume surrounding at least a central portion of the insulator and, advantageously, that portion extending between the fittings 36 and 38. The volume is substantially sealed to the extent that under an expected range of atmospheric conditions, there is substantially no infiltration of water or water vapor so as to affect performance of the insulator. Nevertheless, certain of the benefits of the invention may be obtained via enclosing the insulator with less than substantial sealing (e.g. providing a small opening of relatively small cross-sectional area which allows pressure equalization across the cover while still substantially protecting the insulator from rain and wind-borne moisture and contaminants). For example, one or more small vent holes 104 (FIGS. 3 & 6) may optionally be provided for pressure equalization. Advantageously, the vent holes are laser-formed, having a circular section of between about 0.005 mm and about 0.01 mm in diameter. Holes of the resulting cross-sectional area are effective to allow pressure equalization while remaining small enough to prevent wind-blown infiltration of water and other contaminants. Even much larger holes (e.g., up to about 1 mm in diameter) may provide effective venting with insignificant compromise of the shielding. Larger ventilation holes in a cover which enshrouds the insulator are possible but not preferred.

A variety of manufacturing techniques such as molding and vacuum forming may be utilized. One preferred method is to vacuum form the halves 60 and 62 from sheet stock 0.06 in thick. This yields a wall thickness for the cover halves of approximately the same 0.06 in.

One or more embodiments of the present invention have been described. Nevertheless, it will be understood that various modifications may be made without departing from the spirit and scope of the invention. For example, the cover may be configured for use with a variety of existing insulators. Additionally, new insulators may be designed for use specifically with the covers of the invention. Fasteners other than the illustrated interlocking projections 68 and receptacle 70*s* (e.g., plastic screws and nuts and/or plastic rivets) may be utilized or bypassed altogether in favor of fastening via adhesive, solvent bonding, heat bonding, etc. These may also replace the exemplary rubber gaskets 72A and 72B sealing the two halves of the cover to each other. Additionally, the gaskets 84 may be replaced or complemented by other sealing means such as caulk, silicone sealant/adhesive, or the like. Optionally, the two cover halves may be unitarily formed, separated by a flexible reduced-thickness hinge portion. When separately formed, the two halves may be hinged along associated flanges by a piano-type hinge or the like. Although the exemplary support structure is a utility pole, the invention may be used with other support structures including the towers used to support high tension lines. Although the exemplary use involves supporting wires from beneath, the inventive cover may be applied to insulators supporting wires from other directions (e.g. wherein the wire is suspended below the cross-arm and the insulator is under tension rather than compression). Accordingly, other embodiments are within the scope of the following claims.

What is claimed is:

1. In an electrical power transmission system of the type having a support structure, a power line, and an insular having a first end secured to the support structure and a second end carrying the power line, the improvement comprising:

an insulative cover having a first end secured to the insular adjacent the insulator's first end and a second end secured to the insulator adjacent the insulator's second end and enshrouding a central portion of the insulator, the first and second cover ends respectively sealed to the first and second insulator ends by at least one gasket.

2. The improvement of claim 1 wherein the first and second insulator ends are respectively formed by first and second metallic endcaps.

3. The improvement of claim 1 wherein first and second tie wraps secure the respective first and second cover ends proximate the first and second insulator ends.

4. In an electrical power transmission system of the type having a support structure, a power line, and an insulator having a first end secured to the support structure and a second end carrying the power line, the improvement comprising:

an insulative cover having a first end secured to the insulator adjacent the insulator's first end having a second end secured to the insulator adjacent the insulator's second end and enshrouding a volume surrounding a central portion of the insulator and comprising:

a first piece and a second piece, each being the unitarily-formed combination of:

a body;

first and second vertical flanges extending along first and second sides of the body, respectively; and first and second collar sections, formed as sectors of a sleeve, at first and second ends of the body.

5. The improvement of claim 4 wherein the bodies of the first and second pieces form a series of reduced diameter regions alternating with a series of enhanced diameter regions, each reduced diameter region having a minimum diameter smaller than maximum diameter of an adjacent enhanced diameter region.

6. The improvement of claim 5 wherein each enhanced diameter region accomodates an associated shed of the insulator.

7. The improvement of claim 5 wherein the series of reduced diameter regions alternating with the series of enhanced diameter regions form a series of sheds, each having an upper surface which substantially slopes downward in the outward radial direction and a lower surface which slopes downward in the outward radial direction and an end surface joining the upper surface and lower surface.

8. The improvement of claim 4 wherein the first and second pieces are formed essentially from a vinylidenefluoride/hexifluoropropylene thermoplastic.

9. The improvement of claim 8 wherein the first and second insulator ends are respectively formed by the first and second metallic end caps and first and second tie wraps secure the respective first and second cover ends proximate the first and second insulator ends.

10. The improvement of claim 8 further comprising gaskets along inner surfaces of the first and second collar sections of the first and second pieces.

11. An apparatus comprising:

a power line in an electrical power transmission system;

an insulator having a first end secured to a support structure and a second end carrying the power line; and an insulative cover having a first end secured to the insulator adjacent the insulator's first end and a second end secured to the insulator adjacent the insulator's second end and defining a volume substantially enclosing at least a central portion of the insulator and wherein gaskets seal the insulative cover to the insulator first and second ends and have adhesive on two surfaces.

12. The apparatus of claim 11 wherein:

the support structure is a utility pole;

the insulator first end comprises a metal fitting bolted to the utility pole; and the insulator second end comprises a metal fitting into which at least one eyebolt is threaded for supporting the power line.

13. The apparatus of claim 11 wherein the insulator's first end is an upper end and the insulator's second end is a lower end.

14. The apparatus of claim 11 wherein the power line carries an alternating current voltage in excess of one kV.

15. The apparatus of claim 11 wherein a body portion of the cover comprises a material selected from the group consisting of VDF/HFP, PDVF, PTFE, FEP, ETFE, ECTFE, polypropylene, polyvinyl chloride, polyethylene (Type 1), polyethermide, and polyethersulfone and has a dielectric strength greater than 10 kV/mm, a volume resistance of $10^{13}$–$10^{16}$ Ohm-cm, a surface resistance of $10^{15}$–$10^{17}$ Ohm, a dielectric constant of 2.5–8, a dissipation factor of $10^{-3}$–$10^{-1}$, a coefficient of linear thermal expansion of $10^{-6}$–$10^{-4}$ in/in °F. and a twenty-four hour water absorption of 0.01%–0.04%.

16. A combination device for supporting a power line relative to a support structure in an electrical power transmission system, comprising:

an insulator having a first end secured to the support structure and a second end carrying the power line; and an insulative cover having a first end secured to the insulator adjacent the insulator's first end and a second end secured to the insulator adjacent the insulator's second end and defining a sealed volume substantially enclosing at least a central portion of the insulator.

17. A combination device for supporting a power line relative to a support structure in an electrical power transmission system, comprising:

an insulator having a first end secured to the support structure and a second end carrying the power line, an insulative cover having a first end secured to the insulator adjacent the insulator's first end and a second end secured to the insulator adjacent the insulator's second end and defining a volume substantially enclosing at least a central portion of the insulator and including at least one vent hole no greater than one square millimeter in cross-section.

18. The device of claim 17 wherein the insulative cover is formed in two portions, each having a body and a pair of flanges.

19. A method for protecting an insulator in an electrical transmission system from environmental contaminants, said system having a support structure, a power line, and an insulator having a first end secured to the support structure and a second end carrying the power line, said method comprising:

providing an insulative cover;

surrounding the insulator with the cover by:

placing a first cover half on a first side of a separation plane extending longitudinally through the insulator;

placing a second cover half on a second side of the separation plane; and securing the first half end to the second half;

securing a first end of the cover to the insulator adjacent the insulator's first end; and securing a second end of the cover to the insulator adjacent the insulator's second end so as to define a volume surrounding a central portion of the insulator and effective to protect such central portion from environmental contaminants.

20. The method of claim 19 wherein the volume is a substantially sealed volume.

21. A combination device for supporting a power line relative to a support structure in an electrical power transmission system, comprising:

an insulator having a first end secured to the support structure and a second end carrying the power line, an insulative cover formed in two halves vacuum-formed to accommodate sheds of the insulator and having a first end secured to the insulator adjacent the insulator's first end and a second end secured to the insulator adjacent the insulator's second end and defining a volume substantially enclosing at least a central portion of the insulator.

* * * * *